United States Patent [19]

Pacilio

[11] 4,305,497

[45] Dec. 15, 1981

[54] COMBINATION COIN AND PASS HOLDER

[76] Inventor: Fred Pacilio, 4838 Wellington, Chicago, Ill. 60641

[21] Appl. No.: 183,188

[22] Filed: Sep. 2, 1980

[51] Int. Cl.[3] ..... A45C 11/00; A45C 15/00; G07D 1/00; B65D 83/00

[52] U.S. Cl. ..... 206/0.81; 206/38; 206/39; 206/45.31; 40/10 R

[58] Field of Search ..... 206/0.81, 38, 45.31, 206/39; 40/10, 20 R

[56] References Cited

U.S. PATENT DOCUMENTS

| | | | |
|---|---|---|---|
| 501,279 | 7/1893 | Knight | 206/39 |
| 1,544,463 | 6/1925 | Lengsfield | 206/45.31 |
| 1,860,586 | 5/1932 | McIlhenny | 206/45.31 |
| 3,027,995 | 4/1962 | Littman | 206/0.81 |
| 3,550,763 | 12/1970 | Rushlow | 206/38 |
| 3,579,878 | 5/1971 | Griffin | 206/0.81 |

*Primary Examiner*—William T. Dixson, Jr.
*Attorney, Agent, or Firm*—Edward C. Threedy

[57] ABSTRACT

An identification pass holder and coin dispenser adapted to be worn about a person's neck from where it can be readily displayed and single-handedly operated to dispense preloaded coins.

5 Claims, 4 Drawing Figures

Special
USERS
TRAVEL CARD
Senior Citizen
10
11
12
13
14
16
17
18
19
20
21
22
23
24
25
26
27
28
"C"

COMBINATION COIN AND PASS HOLDER

SUMMARY OF THE INVENTION

With the advent of special class identification passes and cards such as those issued to senior citizens, permitting them a cost reduction in many services and commodities, as well as the requirement of exact fare for public transportation, it has become necessary to provide a combination pass and fare holder. It is to satisfy this need that the present invention is directed.

The invention has for its principal object the aid to a senior citizen who, upon boarding a vehicle of public transportation, must utilize both his arms and hands in boarding the vehicle. In most instances, an exact fare is required, and that fare is adjusted for the senior citizen classification. With the advent of my invention, the person may retain a hold upon a supporting rail or the like with one hand, and with the other readily display his senior citizen's pass and, by a simple operation of closing a clamp-like member, dispense a series of coins directly into the vehicle fare box.

One object of this invention is to facilitate the display of an identification pass, and at the same time permit the dispensing of coins such as for transportation fare.

To accomplish this object, I have provided a small box-like article consisting of a cover and jaw hinged together so that the box-like structure can be partially opened.

A further object of my invention is to provide, on the top surface of the cover, edge channels into which can be slideably positioned and retained an identification pass or the like.

GENERAL DESCRIPTION OF THE DRAWINGS

The invention will be best understood from the accompanied drawings which illustrate the preferred form of carrying out my invention and by which the objects thereof are accomplished and in which, FIG. 1 is a perspective view of the combination pass and fare holder.

GENERAL DESCRIPTION OF THE INVENTION

Figures 1, 2, 3, 4:
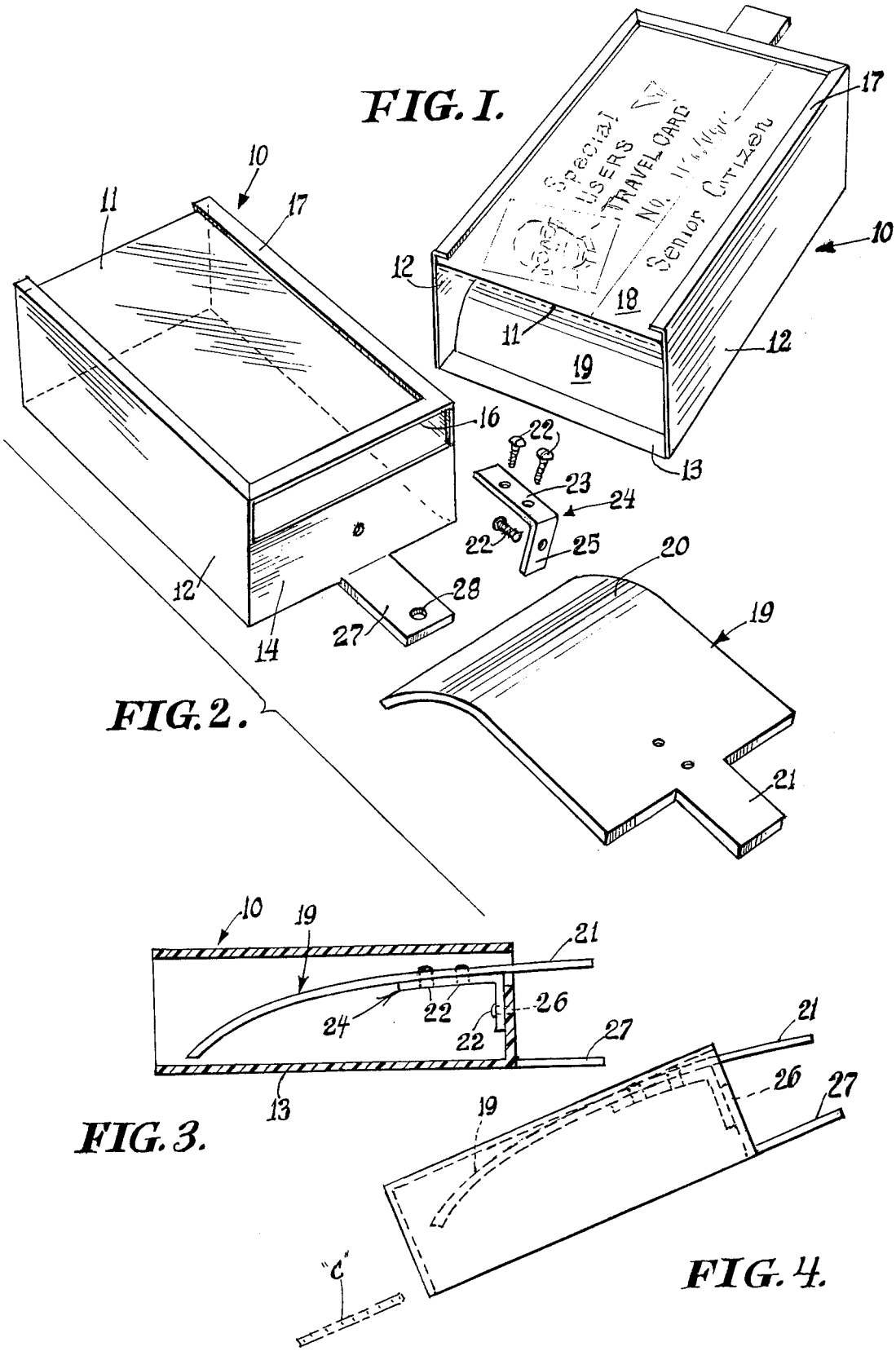
FIG. 2 is a perspective view of the parts of the invention shown in exploded relationship.
FIG. 3 is a detailed sectional side elevation view of the invention.
FIG. 4 is a side elevation and view of the invention showing it in a coin dispensing condition.

The combination pass and fare holder of this invention is illustrated in FIG. 1 and is identified by the numeral 10. The holder 10 consists of two parts which are preferably formed from a moldable plastic material so as to be rigid, yet light in weight.

As shown in FIG. 2, the holder 10 is of a box-like structure comprising a top wall 11, side walls 12, a bottom wall 13, and a partial rear wall 14.

Extending upward from the junction of the side walls 12 with the top wall 11, as well as from the rear edge 16 of the top wall 11, is a channel-forming flange 17. The flange 17 defines an identification pass viewing area and is adapted to functionally receive therebeneath a pass 18 such as the one shown in FIG. 1.

Completing the fare holder 10, there is provided a jaw 19 which consists of an elongated tapered top wall 20. A finger tab 21 extends rearwardly from the top wall 20 of the jaw 19 as shown. As shown in FIGS. 1, 3 & 4, the jaw 19 is adapted to fit within the holder 10 with the jaw 19 being of a width to extend between the side walls 12 of the holder 10 with the curved front end adjacent to the open end of the holder 10.

To the underside of the jaw 19 is connected by means of set screws 22 and the like one arm 23 of a flat spring 24. The other arm 25 of the spring 24 is adapted to accept a mounting screw 26 by which it is attached to the partial rear wall 14 as shown in FIGS. 3 & 4.

It is to be noted that in assembling the jaw 19 into the holder 10, it is inserted through the front opening of the holder 10 with its finger tab 21 extending out beyond the partial rear wall 14. The spring 24 will have been preconnected to the underside of the jaw 19, and working through the front end of the holder 10, the arm 25 of the spring 24 can be attached to the rear wall 14.

The spring 24 will be biased so as to maintain the jaw 19 in a close position upon the bottom wall 13 of the holder 10 as seen in FIG. 1.

Extending rearwardly from the partial rear wall 14 in the plane of the bottom wall 13 of the holder 10 is a second finger tab 27. This finger tab 27 may be provided with an opening 28 through which a chain or the like may be attached so that the combination pass and fare holder may be worn about the neck of a user.

It should be noted that, as clearly shown in FIGS. 3 and 4, the finger tab 21 of the jaw 19 rests upon the top edge 29 of the partial rear wall 14. In this position, the jaw 19 may more or less pivot upon the edge 29 when the finger tab 21 is compressed in the direction of the fixed finger tab 27 against the bias of the spring 24. The partial rear wall 14, like the side walls 12 and bottom wall 13 of holder 10, closes the rear portion of the jaw 19 and prevents coins from slipping out of the holder 10 prior to the jaw 19 being pivoted into an open condition within the holder 10.

The user will, prior to its use, preload the holder 10 with the exact fare. This is accomplished by compressing the finger tab 21 of the jaw 19 in the direction of the finger tab 21 of the holder 10 in the manner shown in FIG. 4. After the holder has been preloaded, the coins "C" (see FIG. 4) may be dispensed by once again pivoting the jaw 19 within the holder as heretofor described.

While I have illustrated and described the preferred form of construction for carrying my invention into effect, this is capable of variation and modification without departing from the spirit of the invention. I therefore do not wish to be limited to the precise details of construction as set forth, but desire to avail myself of such variations and modifications as come within the scope of appended claims.

Having thus described my invention, what I claim as new and desire to protect by LETTERS PATENT is:

1. A combination pass and fare holder consisting of a box-like structure comprising:

(a) a holder having a top wall, bottom wall, side walls, and a partial rear wall, (b) means extending above and about the edges of said side walls and one open end of said holder for retaining a pass upon the surface of said top wall, (c) a pivotal jaw within said holder, (d) means pivotally connecting said jaw within said holder with said jaw normally closed by said bottom and side walls of said holder, and (e) means provided by said holder and said jaw by which said jaw is pivoted about said connecting means so as to expose its open bottom within said holder so that any coins contained therein will pass freely out of the open end of said holder.

2. A combination pass and fare holder as defined by claim 1 wherein said means for pivotally connecting said jaw within said holder comprises a spring having opposite free ends in contact with said jaw and said partial rear wall of said holder.

3. A combination pass and fare holder as defined by claim 1 wherein said means provided by said holder and said jaw by which said jaw is pivoted about said connecting means comprises finger tabs provided by said holder and said jaw with said finger tabs when normally compressed together pivoting said jaw within said holder into a position to expose any coins contained within said jaw and permit them to pass out the open end of said holder.

4. A combination pass and fare holder as defined by claim 3 wherein said means for pivotally connecting said jaw within said holder comprises a spring having opposite free ends in contact with said holder and said jaw with said springs bias maintaining the jaw within said holder with its normally open bottom closed by the bottom wall of said holder.

5. A combination pass and fare holder as defined by claim 4 wherein said finger tabs extend rearwardly and exteriorly of said holder and said jaw so as to be readily available for manual compression therebetween so as to pivotally displace said jaw within said holder so as to provide open communication through the open bottom of said jaw for the dispensing of coins contained therein out of the forward open end of said holder.

* * * * *